US011525195B2

(12) United States Patent
Wu

(10) Patent No.: US 11,525,195 B2
(45) Date of Patent: Dec. 13, 2022

(54) WOVEN TEXTILE FOR BAG AND BAG

(71) Applicant: JHIH HUEI TRADING CO., LTD., Changhua County (TW)

(72) Inventor: Yung-Yu Wu, Changhua County (TW)

(73) Assignee: JHIH HUEI TRADING CO., LTD., Changhua County (TW)

( * ) Notice: Subject to any disclaimer, the term of this patent is extended or adjusted under 35 U.S.C. 154(b) by 258 days.

(21) Appl. No.: 16/884,750

(22) Filed: May 27, 2020

(65) Prior Publication Data

US 2021/0372013 A1 Dec. 2, 2021

(51) Int. Cl.
*D03D 1/04* (2006.01)
*D04B 21/20* (2006.01)

(52) U.S. Cl.
CPC ..... *D03D 1/04* (2013.01)

(58) Field of Classification Search
CPC ..... D03D 1/04; D04B 21/20
See application file for complete search history.

(56) References Cited

U.S. PATENT DOCUMENTS 77,516 A * 5/1868 Miller ..... B65D 33/10 383/119
130,711 A * 8/1872 Gillette ..... B27J 1/02 147/48
179,405 A * 7/1876 Dunn ..... A01K 25/00 119/832
409,432 A * 8/1889 Spelman ..... B65D 9/10 217/122
639,708 A * 12/1899 Certain ..... B62J 7/04 224/430
768,855 A * 8/1904 Hoyle ..... D01D 5/253 428/397
769,383 A * 9/1904 Hoyle ..... D01D 5/253 428/397
936,520 A * 10/1909 Calef ..... D03D 25/00 245/8
1,078,022 A * 11/1913 Wahra ..... A01K 13/006 54/80.4
1,154,043 A * 9/1915 Morton ..... A45C 13/26 229/117.24

(Continued)

OTHER PUBLICATIONS

Textile. (n.d.) American Heritage® Dictionary of the English Language, Fifth Edition. (2011). Retrieved Apr. 6, 2022 from https://www.thefreedictionary.com/textile (Year: 2011).*

*Primary Examiner* — Robert H Muromoto, Jr.
(74) *Attorney, Agent, or Firm* — Muncy, Geissler, Olds & Lowe, P.C.

(57) ABSTRACT

A woven textile for a bag is provided, including a main body, the main body includes a woven portion and at least one braided portion, the main body defines a lateral direction and a longitudinal direction which is perpendicular to the lateral direction, the woven portion at least includes a plurality of longitudinal threads and at least is woven by the plurality of longitudinal threads, the plurality of longitudinal threads are arranged along the lateral direction, each said longitudinal thread extends along the longitudinal direction, two ends of the woven portion on the longitudinal direction are respectively a first end and a second end, and at least one said longitudinal thread extends from the first end and the second end away from the woven portion to be braided to form the at least one braided portion.

6 Claims, 2 Drawing Sheets

(56) References Cited

U.S. PATENT DOCUMENTS 1,294,092 A * 2/1919 Greenlee et al. ..... B65D 9/10 217/122
1,294,093 A * 2/1919 Greenlee et al. ..... B65D 9/10 217/122
1,424,972 A * 8/1922 Ambler et al. ..... B27J 1/02 147/48
1,503,337 A * 7/1924 Seigle ..... H01B 13/06 428/164
1,522,201 A * 1/1925 Mittleburg ..... B44F 1/10 217/17
1,879,466 A * 9/1932 Pierce ..... B65D 7/14 220/490
1,881,864 A * 10/1932 Nash ..... B65D 25/2879 217/125
2,268,598 A * 1/1942 Kellems ..... B66C 1/127 29/283
2,318,164 A * 5/1943 Kellems ..... B66C 1/127 254/134
2,325,853 A * 8/1943 Harlem ..... A45C 3/04 383/33
2,488,715 A * 11/1949 Eggl ..... B65D 7/14 217/122
2,665,727 A * 1/1954 Fite ..... A63B 55/00 206/315.7
2,774,186 A * 12/1956 Wilkins ..... A47G 7/06 47/41.01
2,829,853 A * 4/1958 Wheeler ..... F24B 15/04 294/142
2,980,312 A * 4/1961 Gould ..... A45C 3/04 383/18
2,987,239 A * 6/1961 Atwood ..... B65D 33/12 383/20
2,992,768 A * 7/1961 Gatward ..... B65D 33/12 383/92
3,105,628 A * 10/1963 Mack ..... B65D 33/06 383/20
3,208,492 A * 9/1965 Braithwaite ..... B65D 33/065 383/20
3,277,231 A * 10/1966 Downey ..... H01B 7/0072 174/69
3,299,674 A * 1/1967 Scheibe ..... D04B 21/18 66/195
3,373,925 A * 3/1968 Gatward ..... B65D 33/12 D9/434
3,456,865 A * 7/1969 Frank ..... B65D 5/46024 229/125.41
3,632,714 A * 1/1972 Fairbanks ..... B29C 48/05 164/489
3,686,382 A * 8/1972 Fairbanks ..... D04C 3/48 264/DIG. 81
3,861,581 A * 1/1975 Sellors ..... B65D 5/3621 229/117
3,868,137 A * 2/1975 Friend ..... B66C 1/18 294/74
4,000,344 A * 12/1976 Dilbey ..... B66C 1/127 442/352
4,156,308 A * 5/1979 Gebhart ..... B27J 7/00 2/200.1
4,158,985 A * 6/1979 Looker ..... B66C 1/127 87/53
4,181,234 A * 1/1980 Feighan ..... A47G 7/047 248/318
4,347,680 A * 9/1982 Kaestner ..... A01K 73/06 43/4.5
4,365,658 A * 12/1982 Stevens ..... A45C 3/04 383/29
4,378,725 A * 4/1983 Hospers ..... D04G 1/00 57/7
4,491,052 A * 1/1985 Holm ..... D04C 1/06 87/3
4,613,473 A * 9/1986 Layden ..... C03B 37/15 264/258
4,664,266 A * 5/1987 Fausett ..... A47B 96/022 D6/567
4,691,369 A * 9/1987 Costa ..... B65D 33/12 383/17
4,875,482 A * 10/1989 Hariri ..... A61B 17/42 606/122
4,876,818 A * 10/1989 Fralick ..... D07B 1/148 28/166
RE33,232 E * 6/1990 Fausett ..... A45F 3/22 211/87.01
4,934,535 A * 6/1990 Muckenfuhs ..... B65D 83/0847 221/302
4,966,286 A * 10/1990 Muckenfuhs ..... B65D 33/08 206/83.5
4,979,833 A * 12/1990 Cook ..... A45C 3/00 383/117
5,022,216 A * 6/1991 Muckenfuhs ..... B65D 83/0847 53/529
5,036,978 A * 8/1991 Frank ..... B65D 75/5833 383/207
5,050,742 A * 9/1991 Muckenfuhs ..... B65D 85/07 383/207
5,050,999 A * 9/1991 Van Loon, III ..... A45C 3/045 493/239
5,054,619 A * 10/1991 Muckenfuhs ..... B65D 85/07 206/83.5
5,065,868 A * 11/1991 Cornelissen ..... B65D 33/02 206/83.5
5,066,363 A * 11/1991 Lee ..... B65D 65/46 206/83.5
5,118,201 A * 6/1992 Cook ..... A45C 3/045 383/74
5,328,266 A * 7/1994 Davis ..... B65D 33/105 383/14
5,396,864 A * 3/1995 Mannschreck ..... A01K 1/0125 119/168
5,845,994 A * 12/1998 Rice ..... A45C 1/04 383/117
5,926,924 A * 7/1999 Tsai ..... A45C 13/26 16/419
6,305,875 B1 * 10/2001 Matsumoto ..... D04B 21/20 405/32
6,630,414 B1 * 10/2003 Matsumoto ..... A47C 31/006 428/116
D598,194 S * 8/2009 Turvey ..... D3/289
D599,550 S * 9/2009 Turvey ..... D3/289
8,177,431 B2 * 5/2012 Turvey ..... B65D 37/00 383/117
8,256,063 B2 * 9/2012 Bowman ..... A45C 13/26 16/114.1
8,746,495 B2 * 6/2014 Turvey ..... A45C 7/0077 220/666
9,434,512 B2 * 9/2016 Branyon ..... B65D 33/06
10,259,616 B2 * 4/2019 Korinek ..... B65D 33/02
2001/0003912 A1 * 6/2001 Jackon, Jr. ..... D04B 21/18 66/170
2002/0148400 A1 * 10/2002 Eagles ..... B65D 88/78 114/256
2002/0161388 A1 * 10/2002 Samuels ..... A61M 25/10 428/36.9
2005/0189046 A1 * 9/2005 Lefgren ..... C22F 1/14 148/678
2005/0240261 A1 * 10/2005 Rakos ..... A61F 2/90 623/1.51
2006/0154025 A1 * 7/2006 Hess ..... B60P 7/0823 428/131
2008/0277017 A1 * 11/2008 Kwon ..... A47L 13/16 139/384 R
2009/0120270 A1 * 5/2009 Welch ..... D04C 1/12 87/8
2009/0155564 A1 * 6/2009 Bansal ..... B01D 69/148 428/305.5
2012/0237707 A1 * 9/2012 Beraud ..... D03D 15/267 428/36.3
2012/0267017 A1 * 10/2012 Sloan ..... A45C 3/06 150/103

(56) References Cited

U.S. PATENT DOCUMENTS

| | | | | |
|---|---|---|---|---|
| 2013/0051709 | A1* | 2/2013 | Roether | A43B 23/0245 383/117 |
| 2018/0044849 | A1* | 2/2018 | Parrella | C03C 25/36 |
| 2018/0045275 | A1* | 2/2018 | Holtet | F16G 11/106 |
| 2020/0046099 | A1* | 2/2020 | Wang | A45C 13/02 |
| 2020/0347525 | A1* | 11/2020 | Kaneko | D04B 1/14 |
| 2021/0010169 | A1* | 1/2021 | Wu | D03D 15/497 |
| 2021/0017678 | A1* | 1/2021 | Wu | D03D 15/00 |
| 2021/0180227 | A1* | 6/2021 | Wu | D04B 21/12 |
| 2021/0277548 | A1* | 9/2021 | Wu | D04B 1/102 |
| 2022/0017277 | A1* | 1/2022 | Vallcanera Vilanova | A45C 11/20 |
| 2022/0053744 | A1* | 2/2022 | Stubbs | A01K 69/06 |

* cited by examiner

WOVEN TEXTILE FOR BAG AND BAG

BACKGROUND OF THE INVENTION

Field of the Invention

The present invention relates to a woven textile, and more particularly to a woven textile for a bag and the bag.

Description of the Prior Art

Generally, handbags or bags are mostly made of leather or plastic. To provide more variety for bags, some bags are woven, and this type of bags can be seen in both masstige brands and high-end luxury brands.

A woven bag may be formed in following ways: integrally woven, with at least a circumferential panel of the woven bag integrally woven, or with two ends of a panel sewed after the panel is woven. It is difficult and time-consuming to manufacture the woven bag, and since the woven bags are in different shapes and sizes, the setting of a weaving machine needs to be changed according to the shapes and sizes; that is, each type of the woven bags has to be manufactured in its unique way.

In addition, regarding a handle of a woven bag, it is usually made by connecting a ready-made handle to a bag body directly, and the handle may fall off. Besides, since the handle is not made with the same material as the bag body, the look of the whole bag may be uncoordinated.

The present invention has arisen to mitigate and/or obviate the afore-described disadvantages.

SUMMARY OF THE INVENTION

The major object of the present invention is to provide a woven textile for a bag and the bag, and the woven textile can be connected in different ways to form the bag in different shapes or sizes.

To achieve the above and other objects, a woven textile for a bag is provided, including a main body, the main body includes a woven portion and at least one braided portion, the main body defines a lateral direction and a longitudinal direction which is perpendicular to the lateral direction, the woven portion at least includes a plurality of longitudinal threads and at least is woven by the plurality of longitudinal threads, the plurality of longitudinal threads are arranged along the lateral direction, each said longitudinal thread extends along the longitudinal direction, two ends of the woven portion on the longitudinal direction are respectively a first end and a second end, and at least one said longitudinal thread extends from the first end and the second end away from the woven portion to be braided to form the at least one braided portion.

To achieve the above and other objects, a bag is further provided, including a plurality of bag components, the plurality of bag components are integrated to define a storage space, at least one said bag component is the woven textile for the bag, and the main body is connected to another said bag component with at least one part of the plurality of braided portions.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
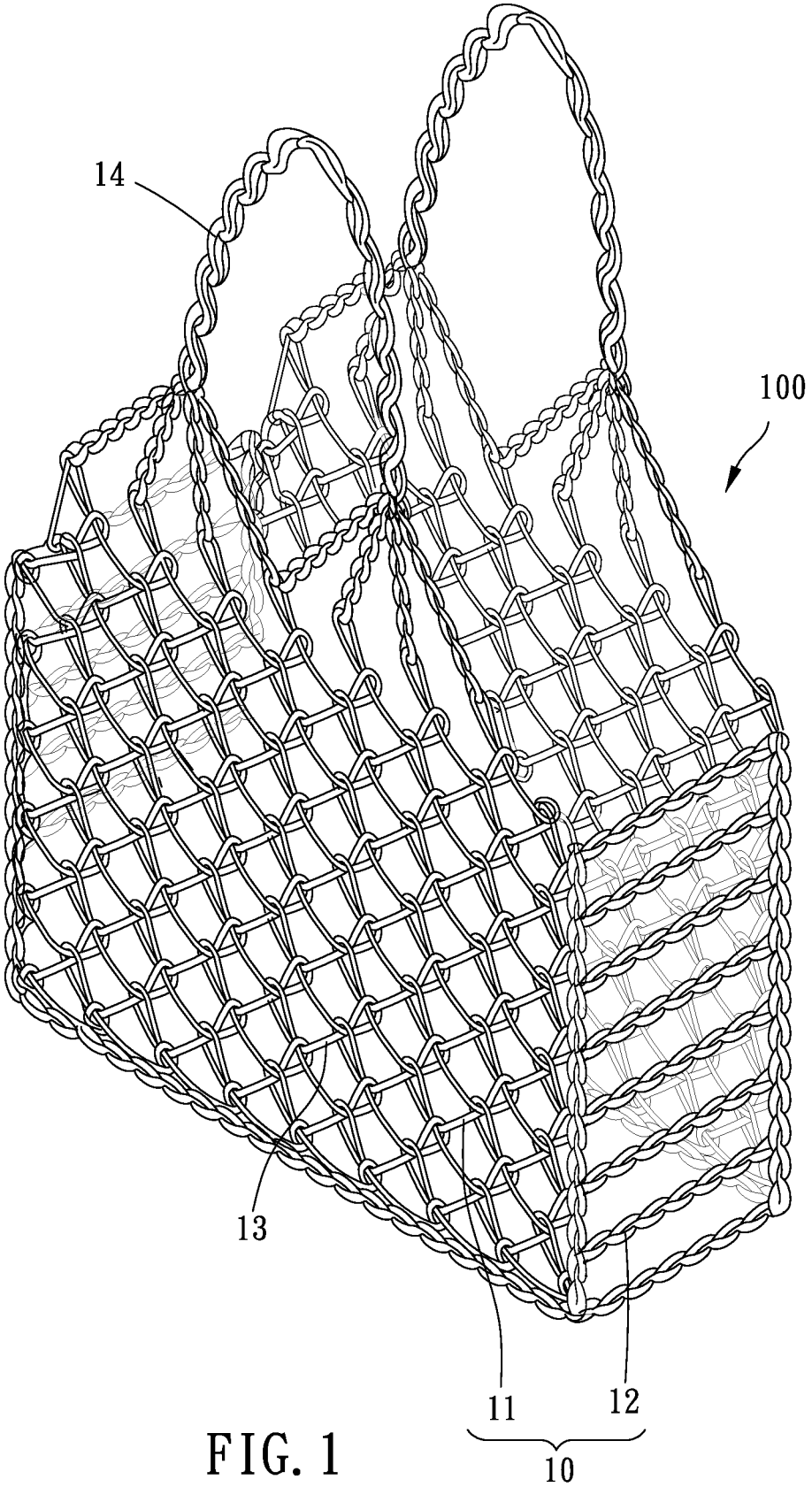
FIG. 1 is a stereogram of the present invention.
Figure 2:
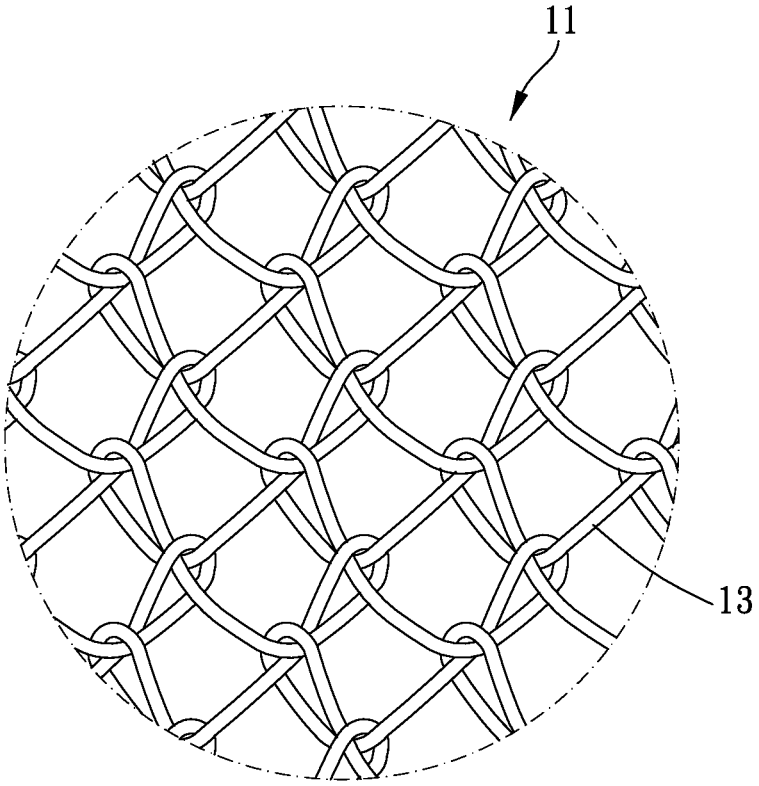
FIG. 2 is a partially-enlarged view of the present invention.

Please refer to FIGS. 1 and 2, a woven textile for a bag is provided, including a main body 10, the main body 10 includes a woven portion 11 and at least one braided portion 12, the main body 10 defines a lateral direction and a longitudinal direction which is perpendicular to the lateral direction, the woven portion 11 at least includes a plurality of longitudinal threads 13 and at least is woven by the plurality of longitudinal threads 13 (each said longitudinal thread may include one filament or multiple filaments, for example, the multiple filaments may extend altogether or be woven first to form the longitudinal thread), the plurality of longitudinal threads 13 are arranged along the lateral direction, each said longitudinal thread 13 extends along the longitudinal direction, two ends of the woven portion 11 on the longitudinal direction are respectively a first end and a second end, and at least one said longitudinal thread 13 extends from the first end and the second end away from the woven portion 11 to be braided to form the at least one braided portion 12.

In this embodiment, the woven portion 11 is woven by the plurality of longitudinal threads 13; that is, the longitudinal threads 13 which are neighboring to each other are entwined to form the woven portion 11. The main body 10 includes the plurality of braided portions 12, and the plurality of longitudinal threads 13 extend from the first end and the second end away from the woven portion 11 to be braided to form the at least one braided portion 12.

In other possible embodiments, the woven portion 11 may be woven by the plurality of longitudinal threads and a plurality of lateral threads. In other words, the weaving method and the structure of the woven portion are not limited.

In addition, in this embodiment, two ends of each said longitudinal thread 13 respectively extend to form one said braided portion 12; that is, a number of the braided portion 12 is twice a number of the longitudinal thread 13. However, in other possible embodiments, each said braided portion 12 is woven by the plurality of longitudinal threads 13, so the number of the braided portion 12 is smaller than twice the number of the longitudinal thread 13.

A bag 100 is further provided, including a plurality of bag components, the plurality of bag components are integrated to define a storage space, at least one said bag component is the woven textile for the bag, and the main bodies 10 of the plurality of said woven textiles for the bag are connected to each other with at least part of the plurality of braided portions 12. Preferably, the plurality of said woven textiles for the bag at least form a front panel and a back panel of the bag 100, and the front panel and the back panel are connected to each other at two sides of respective ones of the front panel and the back panel with at least part of the plurality of braided portions 12, to form two side portions of the bag 100.

At least one said braided portion 12 forms a handle 14, more particularly, two opposite ends of the plurality of lateral threads may also respectively extend outwardly and be braided to form the plurality of braided portions 12, and the handle may be formed by the braided portion which are made by the plurality of lateral threads.

In other possible embodiments, the woven portion of the main body can integrally form the front panel, the back panel and a bottom portion of the bag, the plurality of braided portions are just on an opening of the bag, and the handle can be formed by connecting the plurality of braided portions on the two sides to each other.

When being used, the shape, size, and types of handle of the bag can be adjusted by cutting the braided portion of the main body, so compared with a handbag which is integrally woven, it is convenient and cost-saving to manufacture the main body. The woven textile for the bag can be used on other parts of the bag, and the plurality of woven textile for the bag can be connected in different ways to form the bags in different shapes and sizes.

While we have shown and described various embodiments in accordance with the present invention, it should be clear to those skilled in the art that further embodiments may be made without departing from the scope of the present invention.

What is claimed is:

1. A bag, including a plurality of bag components, the plurality of bag components being integrated to define a storage space, at least one of the plurality of bag components being a woven textile, the woven textile including a main body, the main body including a woven portion and a plurality of braided portions, the main body defining a lateral direction and a longitudinal direction which is perpendicular to the lateral direction, the woven portion at least including a plurality of threads, each said braided portion is woven by the plurality of threads, the plurality of threads being arranged along the lateral direction, each said thread extending along the longitudinal direction, two ends of the woven portion on the longitudinal direction being respectively a first end and a second end, the woven portion is woven by the plurality of threads, at least one said thread including a plurality of filaments and extending from one of the first end and the second end away from the woven portion to be braided to form the plurality of braided portions, the main body being braided with another one of the plurality of bag components with at least part of the plurality of braided portions.

2. The bag of claim 1, wherein the plurality of threads extend respectively from the first end and the second end away from the woven portion to be braided to form the plurality of braided portions.

3. The bag of claim 2, wherein each said longitudinal thread includes a plurality of filaments.

4. The bag of claim 1, wherein the plurality of bag components include a plurality of said woven textiles, and the main bodies of the plurality of said woven textiles are connected to each other with at least part of the plurality of braided portions.

5. The bag of claim 1, wherein at least one said braided portion forms a handle.

6. The bag of claim 4, wherein the plurality of said woven textiles for at least form a front panel and a back panel of the bag, and the front panel and the back panel are connected to each other at two sides of respective ones of the front panel and the back panel with at least part of the plurality of said braided portions, to form two side portions of the bag.

* * * * *